US008147164B2

(12) United States Patent
Will et al.

(10) Patent No.: US 8,147,164 B2
(45) Date of Patent: Apr. 3, 2012

(54) ROAD MILLER

(75) Inventors: Frank Will, Bremen (DE); Rafael Schomaker, Lingen (DE)

(73) Assignee: Dynapac GmbH, Wardenburg (DE)

( * ) Notice: Subject to any disclaimer, the term of this patent is extended or adjusted under 35 U.S.C. 154(b) by 276 days.

(21) Appl. No.: 12/059,073

(22) Filed: Mar. 31, 2008

(65) Prior Publication Data

US 2008/0247823 A1 Oct. 9, 2008

(30) Foreign Application Priority Data

Apr. 5, 2007 (DE) ..... 10 2007 016 796

(51) Int. Cl.
*E01C 23/088* (2006.01)

(52) U.S. Cl. ..... 404/129

(58) Field of Classification Search ..... 404/129; 299/81.1, 81.2, 81.3
See application file for complete search history.

(56) References Cited

U.S. PATENT DOCUMENTS

| | | | | | |
|---|---|---|---|---|---|
| 4,650,253 | A * | 3/1987 | Clemmow et al. | ..... | 299/81.3 |
| 4,705,321 | A * | 11/1987 | Hedlund | ..... | 299/81.3 |
| 5,007,684 | A * | 4/1991 | Parrott | ..... | 299/81.3 |
| 5,178,078 | A * | 1/1993 | Pendergrass | ..... | 111/128 |
| 5,353,724 | A * | 10/1994 | Wheeley, Jr. | ..... | 111/128 |
| 5,769,169 | A * | 6/1998 | Miksitz | ..... | 172/21 |
| 6,102,485 | A * | 8/2000 | Parrott | ..... | 299/81.3 |
| 7,096,804 | B2 * | 8/2006 | Miller | ..... | 111/128 |
| 7,097,257 | B2 * | 8/2006 | Stehney | ..... | 299/81.3 |
| 2004/0119327 | A1 * | 6/2004 | O'Neill | ..... | 299/81.3 |

* cited by examiner

*Primary Examiner* — Raymond W Addie
(74) *Attorney, Agent, or Firm* — Laurence P. Colton; Smith Risley Tempel Santos LLC

(57) ABSTRACT

A line system (24) for a road miller, which rotates along with the milling roller (11) and which supplies water directly to the nozzles (23) which are arranged on the lateral surface (18) of the milling roller (11), to be arranged in the milling roller (11). Owing to the line system (24), the milling roller (11) no longer needs to be filled with water. The nozzles (23) are instead supplied with water directly from the line system (24) in order to spray the milling region selectively.

28 Claims, 6 Drawing Sheets

ROAD MILLER

STATEMENT OF RELATED APPLICATIONS

This patent application is based on and claims convention priority under 35 USC Section 119 on German Patent Application No. 10 2007 016 796.4 having a filing date of 5 Apr. 2007, which is incorporated herein by this reference.

BACKGROUND OF THE INVENTION

1. Technical Field

The invention relates to a road miller having a set of running gear which has its own drive, and a milling roller which can be driven in rotation and has a cylindrical lateral surface which is provided on its circumference with protruding milling cutters and nozzles for discharging fluid.

2. Prior Art

Road millers are used to remove by milling preferably the complete surface of, in particular, the carriageway covering of roads which have become damaged. A road which is milled in this way serves as a substructure for a road which is to be renewed and on which a new road covering is to be applied. Such road millers are usually self-propelling in design. They have a cylindrical milling roller which can be driven in rotation. A large number of protruding milling cutters are arranged on the outside of a cylindrical lateral surface of the milling roller.

The removal of road coverings by milling using a road miller produces a considerable dust burden. Ever stricter environmental regulations require the formation of dust to be kept within narrow limits. For this purpose, in known road millers either dust which has been produced is sucked away or the formation of dust is reduced by means of a fluid, preferably water. In the latter case, fluid is discharged through nozzles which are assigned to the milling roller. The supply of fluid to the nozzles takes place through a reservoir of liquid in the milling roller. For this purpose, the entire milling roller must be of fluid-tight design. However, the fluid in the milling roller particularly increases its mass, as a result of which when the drive of the milling roller is turning, the fluid which generally fills the entirety of the interior of the milling roller, has to be moved along with it.

BRIEF SUMMARY OF THE INVENTION

The object of the invention is to provide a road miller which permits the nozzles to be effectively supplied with fluid without the interior of the milling roller being filled with fluid.

A road miller for achieving this object has a set of running gear which has its own drive, and a milling roller which can be driven in rotation and has a cylindrical lateral surface which is provided on its circumference with protruding milling cutters and nozzles for discharging fluid, characterized in that the nozzles can be supplied with fluid directly through a line system which is arranged in the milling roller. Accordingly, there is provision for the nozzles to be supplied with fluid directly through a line system which is arranged in the milling roller. Owing to the line system which picks up only a relatively small volume of fluid, the entirety of the interior of the milling roller no longer has to be filled with fluid. The milling roller no longer serves as a water reservoir and accordingly does not need to be fluid-tight either. Each individual nozzle can be supplied individually with fluid by the line system, to be precise preferably with pressurized fluid, for example water. Alternatively, the line system can supply groups of a plurality of selected nozzles with fluid at the same time. As a result, it is no longer necessary to supply all the nozzles with fluid at the same time and constantly allow fluid to be discharged from all the nozzles. Instead, the line system permits individual and, above all, selective supply of fluid to each individual nozzle or to groups of nozzles. There is preferably provision for only nozzles which are located in the working region or else just before it and/or after it to be supplied with fluid at a particular time. In other words, nozzles are supplied on a sectoral basis. In this way it is possible to counteract the generation of dust with relatively low consumption of water at locations where dust can be produced, specifically in the working region of the milling cutters.

There is preferably provision for the line system to be arranged so that it rotates along in the milling roller with the cylinder casing. As a result, the line system does not move in relation to the rotating parts of the milling roller, as a result of which it can be arranged fixed therein.

Furthermore, there is provision that only individual nozzles or groups of nozzles are supplied selectively with fluid by the fluid system, said nozzles or groups of nozzles being located in a specific circumferential area of the milling drum at a particular time. This is preferably at least the working area of the milling roller.

However, it is also possible for the nozzles which are located just before the working area and/or those which are just after the working area of the milling roller to be supplied with fluid. On the other hand, nozzles which are located in other areas at the particular time are not supplied with fluid.

In one embodiment of the milling drum with a centrally rotating shaft there is provision for the line system in the milling drum to be supplied with fluid directly from the shaft. The line system can be connected directly to the shaft because the shaft and the line system rotate, as it were, with the milling roller.

According to a preferred further embodiment of the invention, at least one axial feed duct for supplying fluid to the line system is arranged in the rotating shaft. For this purpose, the at least one feed duct is open towards one end of the shaft, that is to say is preferably embodied as a branch duct. It is therefore possible for the line system in the interior of the milling roller to be supplied with fluid from one end of the shaft.

That end of the shaft in which the at least one axial feed duct in the shaft opens is, according to a further proposal of the invention, assigned a non-moving cap. The non-moving cap permits the milling roller to be connected to an external fluid supply, for example a fluid tank on the road miller. Owing to the relative movement between the non-moving cap, which serves as a fluid connection of the milling roller, and the rotating shaft, at least one seal is provided between the cap and that end of the shaft which is assigned to it.

A plurality of axial feed ducts are preferably arranged in the shaft. The feed ducts which run parallel to one another are then located spaced apart from a longitudinal central axis of the shaft, wherein longitudinal axes of the axial feed ducts run parallel to the longitudinal central axis of the shaft, at a distance therefrom. When there are a plurality of feed ducts in the shaft, the cap is preferably designed always to feed fluid to just one feed duct or a number of feed ducts of the shaft. As a result, the fluid ducts can be supplied with fluid discontinuously and/or periodically. In other words there is no continuous supply of fluid to all the feed ducts but rather individual feed ducts are successively, that is to say alternately, supplied with fluid for a certain time. This is achieved through a corresponding embodiment of the non-moving cap which, if just one feed duct can always be supplied with fluid, permits fluid to be fed to the feed duct which is used at a particular time to supply fluid to certain nozzles over a predetermined rotational angle of the milling roller. If the respective feed duct has left a selected angular range of the milling roller, the supply of fluid to this feed duct is interrupted by the cap and fluid is supplied to the next feed duct in the rotating shaft. This produces the aimed-at supply to the nozzles on a sectoral basis.

In one embodiment of the milling roller with a central, fixed axle around which the cylindrical lateral surface of the milling roller and the drum bottoms which are assigned to the end sides of the lateral surface lying opposite one another rotate, fluid is also supplied to the line system in the milling roller through this axle, but it is not supplied directly. Instead, with this configuration of the milling roller, the non-moving axle is surrounded, at least in certain areas, by a rotating distributor bushing. The distributor bushing rotates along with the milling roller, like the line system, as a result of which the ends of the line system which are directed towards the axle, that is to say towards the centre of the milling roller, can be permanently connected to the distributor bushing.

According to one particular embodiment of the distributor bushing there is provision for the latter to have a plurality of distributor bores or connecting ducts distributed over its circumference. The distributor bores or connecting ducts permit the fluid lines of the line system to be connected.

According to one preferred development of the invention, the non-moving axle has only one radial connecting duct, which extends from the central axial feed duct. However, a plurality of distributor bores are arranged in the distributor bushing. There is further provision for the distributor bores in the distributor bushing to correspond to the connecting duct in the axle in such a way that only some of the distributor bores of the distributor bushing can be fed with fluid by the connecting duct in the axle at any time. Then, only selected nozzles are also supplied with fluid over a certain time period. There is preferably provision that individual nozzles or a group of selected nozzles can be supplied with fluid only over a specific circumferential area of the cylindrical lateral surface of the milling drum when said selected circumferential area is in a specific zone with respect to a full circle rotation of the milling roller. This zone is preferably the working area of the milling cutters and, if appropriate, slightly before it and/or slightly after it.

According to one preferred embodiment of the road miller according to the invention, the line system has fluid lines which extend from the shaft which rotates along with the latter or the distributor bushing which rotates along and surrounds the non-moving axle in certain areas. The fluid lines preferably run approximately in the radial direction in the interior of the milling roller. The fluid lines are formed, in particular, from flexible hoses. The fluid lines can, however, also be formed from rigid pipes of any desired material, for example steel or plastic.

According to an alternative embodiment, the line system can also have distributor pipes and/or distributor chambers in addition to the fluid lines. The distributor pipes or distributor chambers preferably run in the longitudinal direction through the interior of the milling drum, specifically at a distance from and in parallel with the longitudinal central axis thereof.

The distributor pipes are either attached to the inside of the cylindrical lateral surface of the milling roller or are located in the vicinity of the cylindrical lateral surface. Each axially directed distributor pipe is preferably supplied with fluid from a single radial fluid line, in which case, if appropriate, a plurality of fluid lines can also be used to supply fluid to a distributor pipe. Each distributor pipe in turn feeds a plurality of nozzles with fluid simultaneously. There is preferably provision for each distributor pipe to supply fluid simultaneously to a row of nozzles located one next to the other in the longitudinal direction of the milling roller. It is then possible for fluid to be discharged simultaneously for a certain time from a row of nozzles, in particular in the working area of the milling roller, in order to prevent dust from being formed when the damaged road covering is removed by milling. However, it is also conceivable for a plurality of rows of nozzles to be supplied with fluid simultaneously in the working area from a common (single) distributor pipe or from a plurality of parallel distributor pipes.

If the line system has distributor chambers in addition to the fluid lines, said chambers are profiles, specifically flat U-profiles, semicircular profiles or arcuate profiles which run in the longitudinal direction of the milling drum. The distributor chambers are attached in a fluid-tight fashion with their open sides to the inner wall of the cylindrical lateral surface of the milling roller, for example by welding. The plurality of such distributor chambers are distributed evenly over the circumference of the lateral surface. Each distributor chamber is fed from at least one fluid line. The distributor chambers are preferably embodied in such a way that, viewed in the circumferential direction of the milling roller, they extend over a larger area than the cylindrical distributor pipes. As a result, one distributor chamber can supply enough fluid not only to a plurality of milling cutters which are located next to one another in the longitudinal direction of the milling roller but also at the same time also a plurality of milling cutters which follow one another in the circumferential direction. In particular, if the milling cutters are not attached to the outside of the milling drum in a straight line but rather, for example, in a V-shaped configuration, the distributor chambers which, viewed in the circumferential direction, extend over a plurality of milling cutters ensure that all the milling cutters which are in use at a particular time are supplied with sufficient fluid by at least one distributor chamber.

In another embodiment of the road miller, specifically the milling roller thereof, there is provision for the line system for supplying the nozzles to be connected to the drum bottoms which rotate along with the cylindrical lateral surface of the milling roller. The line system is then preferably supplied with fluid from the outside through a drum bottom. This drum bottom is then assigned a non-moving lid which is sealed with respect to the moving drum bottom. The connections of the fluid lines of the line system to the one-sided drum bottom of the milling roller and also on the lid are then located off centre at a distance from the longitudinal central axis of the milling drum which, in this embodiment of the invention, optionally has a fixed axle or a rotating shaft. With this off-centre arrangement of the connection to the lid and the connections of the respective fluid line to the drum bottom there is also provision for the connections on the non-moving lid, on the one hand, and on the drum bottom which rotates with the milling drum, on the other, to become congruent only at certain times, as a result of which the nozzles are supplied with fluid only over a certain sector of the circumference of the milling roller, preferably over the working area of the milling cutters and, if appropriate, slightly before and/or slightly after said working area (supply to nozzles on a sectoral basis). The supply to the nozzles on a sectoral basis can also be positioned more precisely by arranging the fluid connections at an increasing distance from the longitudinal central axis of the milling roller.

Corresponding arcuate grooves in the plate and/or the drum bottom corresponding thereto serve to define the circumferential area through which a jet of fluid will be discharged from the respective nozzle. The discharge of fluid from the different nozzles can be determined in advance on an individual basis through virtually any desired configuration of these grooves.

BRIEF DESCRIPTION OF THE DRAWINGS

Preferred exemplary embodiments of the invention will be explained in more detail below with reference to the drawing, in which.

DETAILED DESCRIPTION OF PREFERRED EMBODIMENTS

Figure 1:
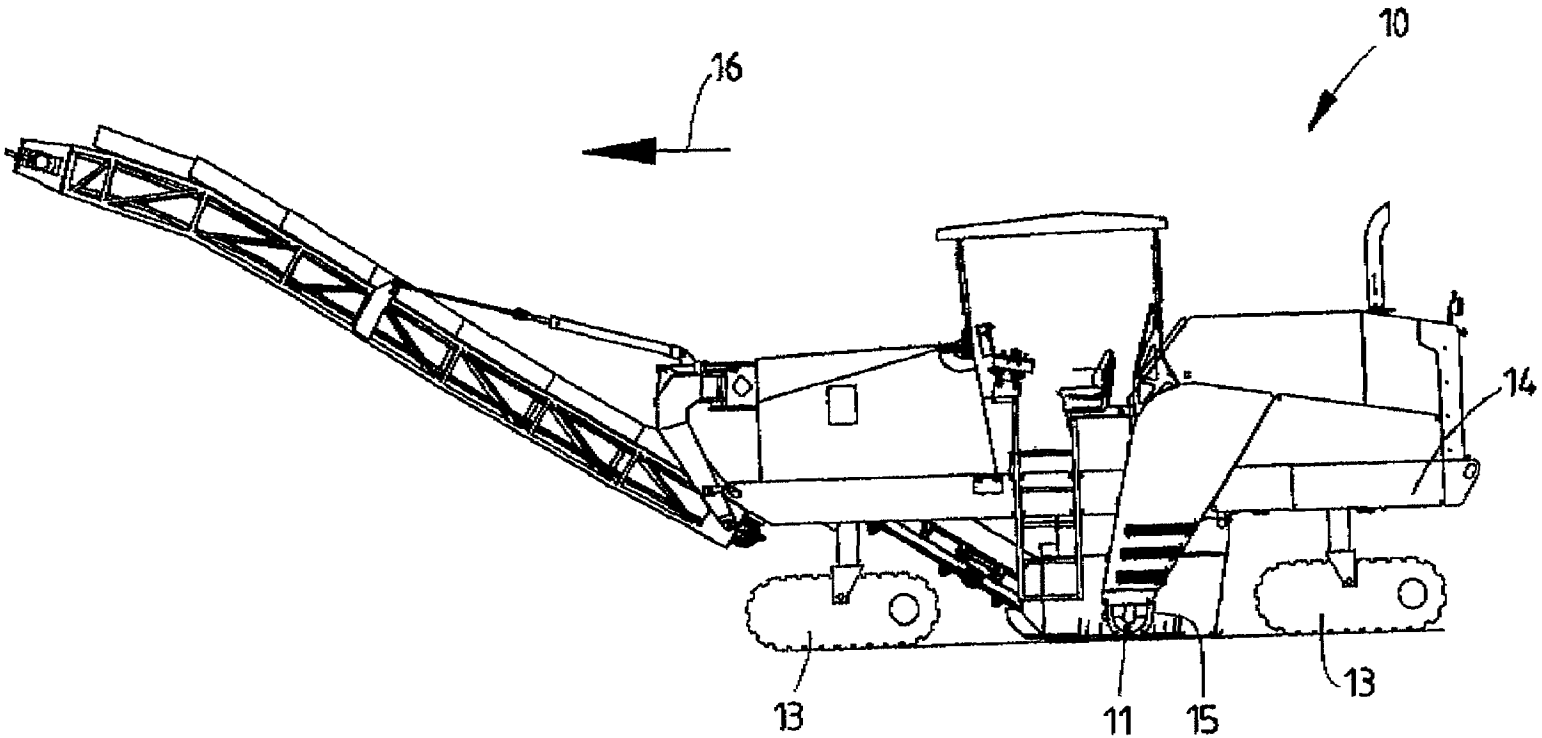
FIG. 1 is a schematic side view of a self-propelling road miller.

FIG. 1 shows a road miller 10 with a cylindrical milling roller 11 for removing damaged and/or worn road coverings by milling. The road miller 10 which is shown is of self-propelling design. For this purpose, the road miller 10 has a corresponding drive which also serves to drive the milling roller 11 in rotation about a horizontal rotational axis 12 which corresponds to the longitudinal central axis of the milling roller 11.

In order to drive the road miller 10 and, in particular, also the milling roller 11, an internal combustion engine is preferably used, said internal combustion engine driving hydraulic pumps which in turn serve to drive hydraulic motors. However, it is also conceivable for the internal combustion engine to drive a generator which generates current for driving electric motors.

The road miller 10 has a set of running gear 13 which, in the exemplary embodiment shown, is embodied as a track laying gear. The set of running gear can, however, also be embodied as running gear with wheels, in particular in the case of relatively small road millers. The set of running gear 13 has a running gear frame 14 which supports a milling roller frame 15. The milling roller frame 15 extends transversely with respect to the milling direction 16 of the road miller 10, specifically preferably over the entire width thereof, in particular over the entire width of the running gear frame 14. However, it is also conceivable, in particular in the case of relatively small road millers, that the milling roller 11 extends over only part of the width of the running gear frame 14.

In the milling roller frame 15, the cylindrical milling roller 11 is arranged in such a way that its horizontal rotational axis 12 extends transversely with respect to the milling direction 16. The milling roller 11 is driven in such a way that its rotational direction 17 runs in the clockwise direction with respect to the illustration in FIG. 1 with the milling direction 16 pointing to the left, with the result that the milling roller 11 works against the milling direction 16.

Figure 2:
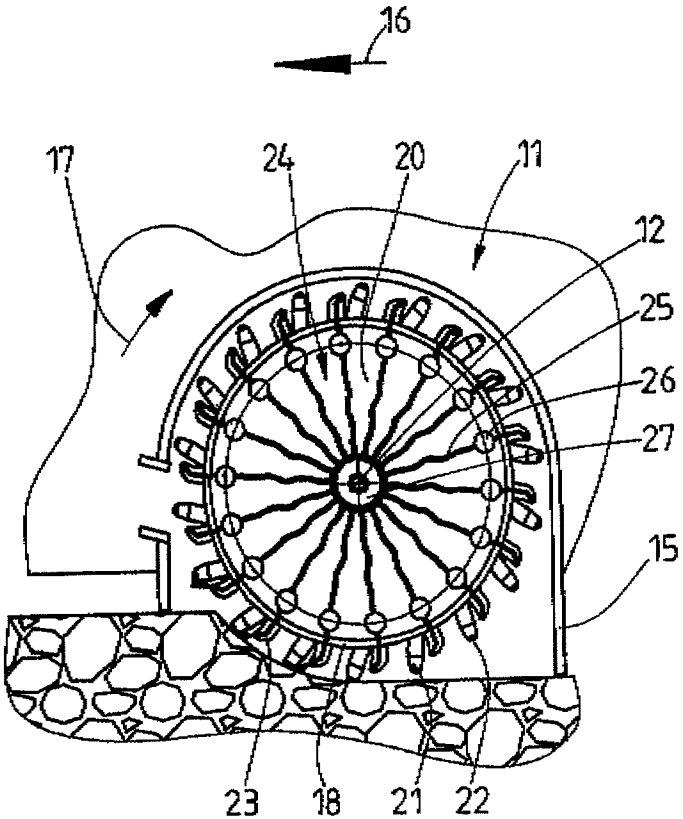
FIG. 2 shows a cross section through a milling roller of the road miller in FIG. 1.
Figure 6:
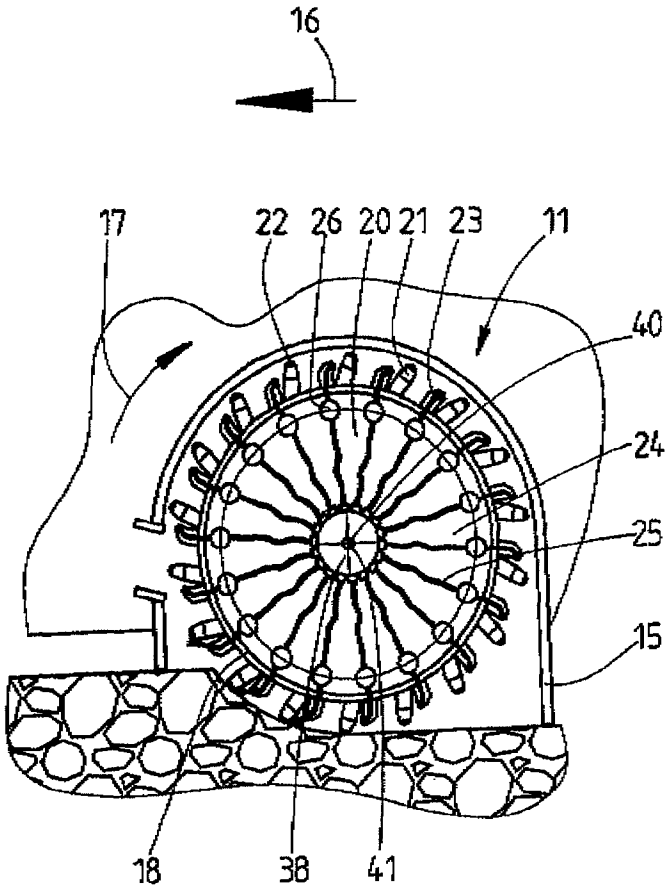
FIG. 6 shows a cross section through a milling roller of a road miller according to a second exemplary embodiment of the invention.

The milling roller 11 has a cylindrical lateral surface 18. The end sides of the lateral surface 18 are closed off by circular ring-shaped drum bottoms 19. In the interior, the milling roller 11 is hollow, to be precise it has a cylindrical interior 20. A plurality of milling cutters 21, which are preferably the same as one another, are arranged on the outer side of the cylindrical lateral surface 18. The milling cutters 21 are usually distributed evenly over the outer circumference of the lateral surface 18 of the milling roller 11, to be specific usually in a gridlike arrangement. The milling cutters 21 protrude outwardly with respect to the milling roller 11, to be specific all the milling cutters 21 preferably protrude to the same extent. All the milling cutters 21 are inclined to the same degree with respect to the tangent on the attachment point on the outside of the lateral surface 18, specifically with respect to their tips 22 which lead in the rotational direction 17 (FIGS. 2 and 6).

Furthermore, the milling roller 11 is provided with nozzles 23 from which jets of fluid, for example jets of pressurized water, can be discharged. The nozzles 23 are, like the milling cutters 21, arranged in a protruding fashion distributed over the outer circumference of the lateral surface 18 of the milling roller 11. In the exemplary embodiments shown, the shorter nozzles 23 are located behind the milling cutters 21, with in each case one nozzle 23 being preferably arranged behind each milling cutter 21. The nozzles 23 can, however, also be arranged at other locations on the milling roller 11, for example between adjacent milling cutters or next to them. Finally, it is also conceivable to integrate at least one nozzle 23 into each milling cutter 21.

According to the invention, in all the exemplary embodiments the nozzles 23 are supplied directly with a preferably pressurized fluid through a line system 24 which is arranged in the interior of the milling roller 11. The line system 24 is fixedly arranged in the interior of the milling roller 11 so that it rotates in synchronism with the lateral surface 18 and the drum bottoms 19 of the milling roller 11, that is to say there is no relative movement between the line system 24 and the milling roller 11. For this purpose, the line system 24 is fixedly arranged in the milling roller 11, that is to say is arranged in a non-movable fashion in relation to the parts of the milling roller 11 which are driven in rotation. The line system 24 is essentially of identical design in both exemplary embodiments of the invention which are shown in FIGS. 2 to 9.

Accordingly, the line system 24 has a plurality of radially directed fluid lines 25 and a plurality of distributor elements which extend axially through the milling roller 11 and which are embodied as distributor pipes 26 in the exemplary embodiments in FIGS. 2 to 9. The distributor pipes 26 are preferably embodied in a rigid fashion as elongate, straight metal pipes or plastic pipes. The radial fluid lines 25 are preferably manufactured from a flexible material, that is to say embodied in the manner of hoses.

Figure 3:
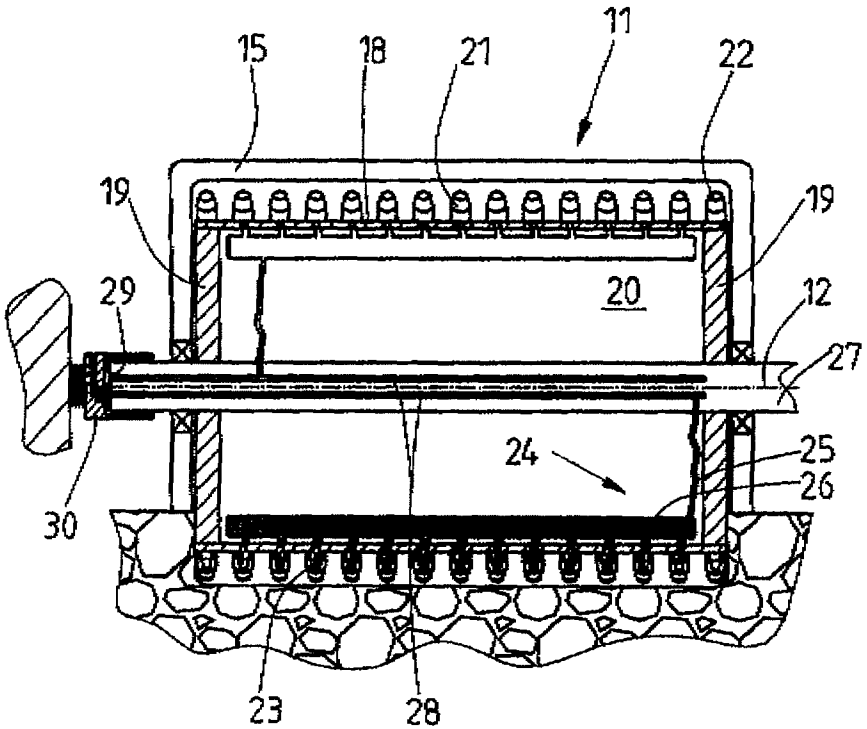
FIG. 3 shows a central longitudinal section through the milling roller in FIG. 2.
Figure 7:
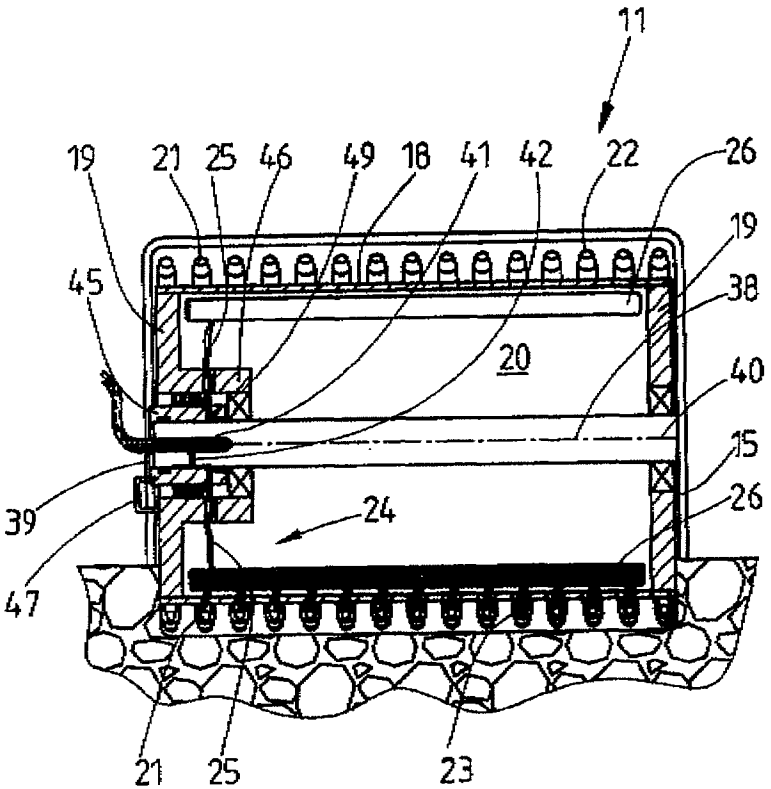
FIG. 7 shows a central longitudinal section through the milling roller in FIG. 6.

The distributor pipes 26 are arranged right against the inner wall of the cylindrical lateral surface 18 of the milling roller 11 at a small distance therefrom. All the distributor pipes 26 run parallel with respect to one another and also parallel with and at an equal distance from the rotational axis 12 of the milling roller 11. In each case a distributor pipe 26 is assigned to a row of nozzles 23 which extends in the longitudinal direction of the milling roller 11. That is to say a row of nozzles 23 is supplied with fluid by a distributor pipe 26. In the exemplary embodiments shown in FIGS. 2 to 9, the distributor pipes 26 extend over approximately the entire length of the interior 20 of the milling roller 11 (FIGS. 3 and 7). The milling roller 11 which is shown has fifteen milling cutters 21 located one next to the other. Depending on the size of the milling cutters 21, the number of milling cutters 21 which are located one next to the other can vary. Since each milling cutter 21 is assigned a nozzle 23, a row of nozzles also has fifteen, preferably identical nozzles 23. All fifteen nozzles 23 in the row are accordingly supplied with fluid from one distributor pipe 26. The supply of fluid to each distributor pipe 26 is provided in each case by a radial fluid line 25. However, it is also conceivable to provide a plurality of fluid lines 25 for supplying a distributor pipe 26 with sufficient fluid. FIGS. 2 and 6 show that, because of the relatively large number of distributor pipes 26 (eighteen distributor pipes 26 in the exemplary embodiments shown in FIGS. 2 to 9) which are distributed evenly over a graduated circle with a somewhat smaller diameter than the lateral surface 18 of the milling roller 11 and the centre point on the rotational axis 12 and the supply of each distributor pipe 26 with fluid via a fluid line 25, the line system 24 has a star-shaped configuration in the axial direction of the milling roller 11.

In the exemplary embodiment in FIGS. 2 to 5, the milling roller 11 has a rotating shaft 27. The drum bottoms 19 which support the lateral surface 18 are permanently connected to the rotating shaft 27. The shaft 27 is mounted on opposite sides of the drum bottoms 19 in the fixed milling roller frame 15.

Six axial feed ducts 28 are arranged in the interior of the shaft 27 in the first exemplary embodiment (FIGS. 2 to 5). All six feed ducts 28 are embodied in the same way. All the feed ducts 28 are equally distant from the longitudinal central axis of the shaft 27 which forms the rotational axis 12 of the milling roller 11 and are specifically arranged at an equal distance on a graduated circle which surrounds the longitudinal central axis. All the feed ducts 28 are open at one end by virtue of the fact that they open at an end side 29 of the shaft 27 which lies outside the milling roller frame 15. The distributor pipes 26 are closed at opposite ends by virtue of the fact that they are formed by blind bores or branch ducts in the shaft 27.

The end side 29 in which all the distributor pipes 26 open is assigned a fixed cap 30. The cap 30 extends with a cylindrical bottom wall 31 before the end side 29 of the shaft 27. A ring wall 32 which adjoins the bottom wall 31 of the cap 30 at one end covers a short end region, projecting out of the milling roller frame 15, of the shaft 27. The non-moving cap 30 is sealed with respect to the rotating shaft 27 both by an axial seal 33 and a radial seal 34.

Figure 5:
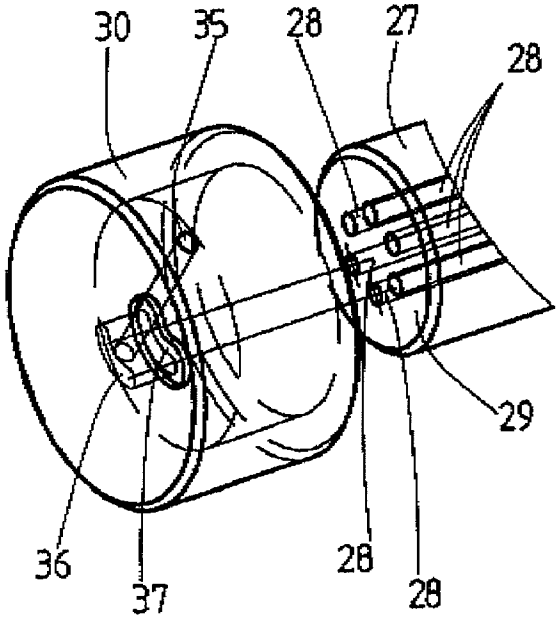
FIG. 5 is a perspective exploded illustration of the feeding of fluid to a shaft.
Figure 4:
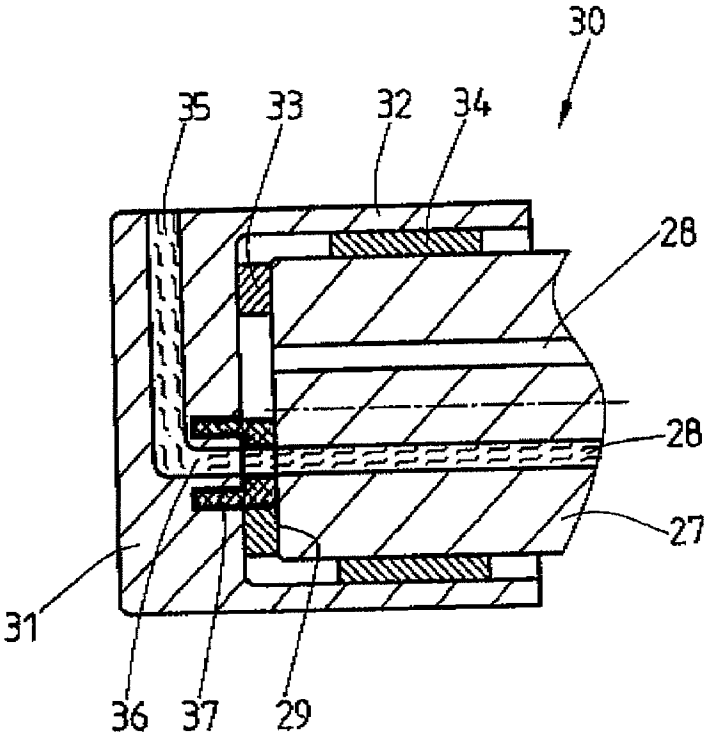
FIG. 4 shows an enlarged detail IV from FIG. 3.

In the bottom wall 31 of the cap 30, a radially directed connecting bore 35 is arranged. At the end of the connecting bore 35 which lies in the interior of the bottom wall 31 there is an adjoining arcuate groove 36 which extends from the inside of the bottom wall 31 which points to the end side 29 of the shaft 27. The arcuate groove is located on a graduated circle with its centre on the rotational axis 12 which corresponds to the graduated circle on which the longitudinal central axes of all the feed ducts 28 are arranged in the shaft 27 (FIGS. 4 and 5). The groove 36 is surrounded on the outside by a circumferential seal 37.

The connecting bore 35 in the cap 30 is supplied with fluid from the outside from an external fluid reservoir, for example a fluid tank, in particular a water tank, of the road miller 10. The fluid reaches the area of the arcuate groove 36 at the end of the connecting bore 35. This arcuate groove 36 is embodied in the exemplary embodiment shown in such a way that just one feed duct 28 or, for a brief time at the junction between one feed duct 28 and the adjacent feed duct 28, two feed ducts 28 can be supplied with fluid. Sectoral fluid supply to the individual feed ducts 28 therefore comes about by virtue of the fact that, as the milling roller 11 rotates, the individual feed ducts 28 are successively supplied with fluid, to be precise in each case only over a part of a revolution of the milling roller 11. In the exemplary embodiment shown with six feed ducts 28, a sixth of a full circle rotation of the milling roller 11, that is to say a circumferential circle of approximately 60° is always successively supplied with fluid.

In the exemplary embodiment in FIGS. 2 to 5, eighteen rows with fifteen nozzles 23 are arranged over the circumference of the milling roller 11. However, because only six feed ducts 28 are provided, three adjacent rows of nozzles are supplied simultaneously with fluid by virtue of the fact that three fluid lines 25 of the line system 24 branch off from each feed duct 28 in the shaft 27, said fluid lines 25 leading to three different distributor pipes 26 of the line system 24 which are located next to one another. If the feed duct 28 which is supplied with fluid from the cap 30 at a particular time moves out of the area of the groove 26 by virtue of the fact that the milling roller 11 has been rotated through a corresponding angle, the next following feed duct 28 is supplied with fluid, as a result of which fluid is discharged simultaneously from the three next rows of nozzles. When there are six feed ducts 28 present, a sixth of the fluid is therefore discharged from the different nozzles 23 when the milling roller 11 rotates. Because the cap 30 with the groove 36 is arranged in a non-moving fashion on the end area of the rotating shaft 27, the position of the groove 36 does not change. Accordingly, those three rows of nozzles which are located in the same circumferential area of the milling roller 11 at a particular time are always supplied with fluid. This circumferential area or sector is located at the point where the milling roller 11 removes the road covering by milling, that is to say in the working area of the milling roller 11. Depending on the size of the sector in which at a particular time fluid is sprayed from the nozzles 23 onto the road covering which is to be removed by milling, it is also possible for the area just before the milling point and/or just after the milling point to be moistened by jets of fluid which are discharged from the nozzles 23. The nozzles 23 are not supplied with fluid from the rest of the circumferential area on which the milling cutters 21 and the nozzles 23 are moved back again until they reach the milling point the next time. According to the invention, there is therefore a sectional supply to the nozzles only at the milling point or at least an area adjoining it.

FIGS. 6 to 9 show a second exemplary embodiment of the invention in which the same reference symbols have been used for functionally identical parts to those in the previously described, first exemplary embodiment.

The road miller 10 in FIGS. 6 to 9 differs from a previously described road miller 10 only in that the milling roller 11 is mounted on a non-moving axle 38.

The axle 38 is mounted fixedly, that is to say non-rotatably, in the milling roller frame 15. This mounting can occur at one end, or at both opposite ends, of the axle 38. Drum bottoms 19 are rotatably mounted at both ends of the axle 38. A single axial feed duct 41 is located centrally in the axle 38, specifically on the longitudinal central axis 40 thereof, and said longitudinal central axis 40 forms at the same time the rotational axis 12 of the milling roller 11. In the exemplary embodiment shown, the feed duct 41 is embodied only as a short branch duct which extends from the end side 39. The feed duct 41 opens at a location on the circumferential surface of the axle 38 via a radial connecting duct 42. In the exemplary embodiment shown, this location is not far away from the end side 39 of the axle 38. At the point where the connecting duct 42 opens in the lateral surface of the axle 38 there is a groove 43 running in the longitudinal direction of the axle 38. Straight seals 44 are assigned to the groove 43 at a short distance from the longitudinal edges, lying opposite one another, of said groove 43.

In order to be able to transfer the fluid from the non-moving axle 38 to the line system 24 which rotates in the milling roller 11, a distributor bushing 45 is assigned to the end area, extending from the end side 39, of the axle 38. In the exemplary embodiment in FIGS. 6 to 9, the distributor bushing 45 is accommodated in a ring 46, accessible from the outside, of the drum bottom 19, assigned to the respective end area of the lateral surface 18, of the milling roller 11. The distributor bushing 45 is therefore accessible from the outside. The distributor bushing 45 rotates together with the milling roller 11. For this purpose there is a connection between the distributor bushing 45 and the drum bottom 19, which connection is illustrated symbolically in FIG. 8 as a bar 47, but it can also be implemented in various other ways. The rotating distributor bushing 45 is sealed with respect to the non-moving axle 38 by means of two radial seals 48 in its end areas lying opposite one another. The radial seals 48 limit opposite end areas of the elongate groove 43 in the axle 38. The longitudinally directed seals 44 are located between the spaced-apart radial seals 48, on opposite longitudinal sides of the groove 43. The groove 43 in the non-moving axle 38 is therefore sealed off on all sides against the discharge of fluid from the distributor bushing 45 which rotates along with the milling roller 11.

Figure 9:
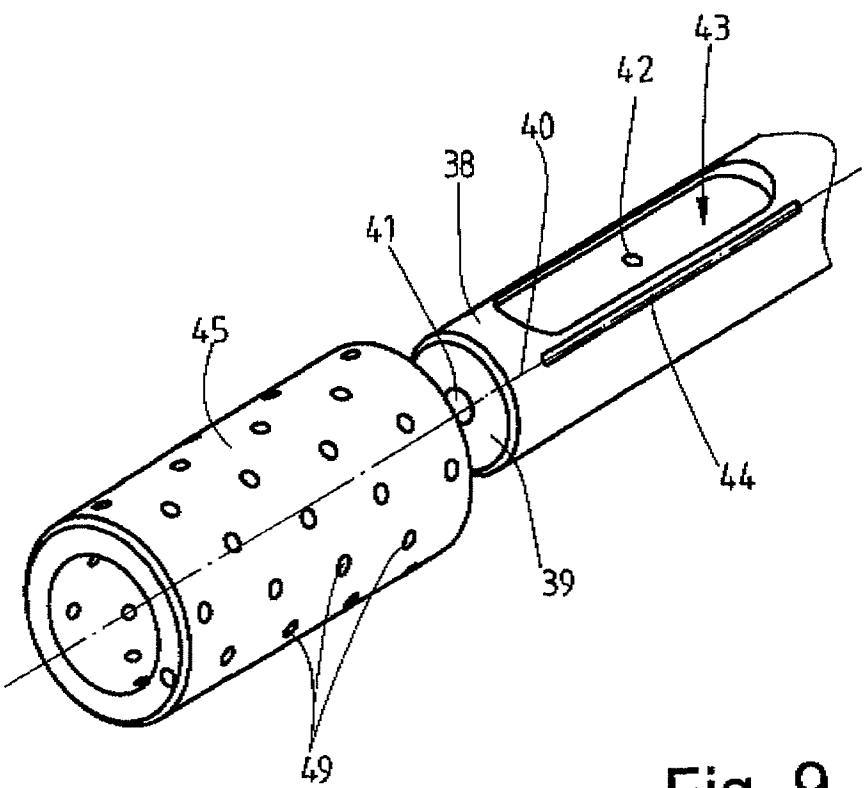
FIG. 9 is a perspective exploded illustration of the supply of fluid to an axle in FIG. 8.
Figure 8:
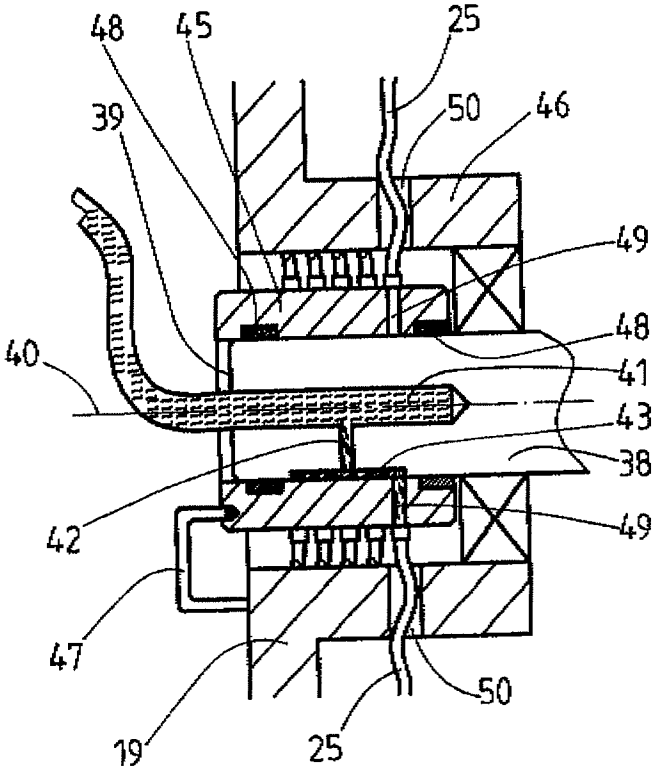
FIG. 8 shows a detail VIII from FIG. 7.

The distributor bushing 45 is provided with a plurality of radial connecting ducts 49. All the connecting ducts 49 are embodied as through-bores with the same diameter. The connecting ducts 49 are distributed in the manner of a grid over the circumference surface of the distributor bushing 45 (FIG. 9). The grid arrangement is made in such a way that the connecting ducts 49 are located on five (virtual) rings 46 which are distributed in the longitudinal direction of the distributor bushing 45 (FIG. 8). A fluid line 25 of the line system 24 is connected to each connecting duct 49, opening in the cylindrical outer surface of the distributor bushing 45. The fluid lines 25 are routed through breakthroughs 50 in the annular mount for the distributor bushing 45 in the drum bottom 19, and they run radially outward from there to distributor pipes 26 of the line system 24. The nozzles 23 are, as described in conjunction with the first exemplary embodiment, supplied with fluid from the distributor pipes 26, embodied and arranged as in the exemplary embodiment in FIGS. 2 to 5, for the purpose of selectively spraying the working area of the milling roller 11 with jets of fluid which are discharged from the respective nozzles 23.

Because the connecting ducts 49 which are distributed over the lateral surface of the distributor bushing 45 successively run past the groove 43 in the non-moving axle 38 at every rotation of the milling roller 11, only individual connecting ducts 49, specifically in each case a group of selected connecting ducts 49, are always supplied with fluid. Accordingly, fluid reaches only individual nozzles 23 via selected fluid lines 25 of the line system 24, as a result of which, during the rotation of the milling roller 11, other nozzles 23 are constantly supplied with fluid via the distributor bushing 45 and the fluid lines 25 with the distributor pipes 26 of the line system 24. Specifically, the sectional spraying over only the working area of the milling roller 11 occurs precisely in the same way as that described in conjunction with the exemplary embodiment in FIGS. 2 to 5. Only those connecting ducts 49 which move into the area of the groove 43 during a rotation of the milling roller 11 are always supplied with fluid over part of the rotation of the milling roller 11. Therefore, the connecting ducts 49 successively move into congruence with the groove 43 so that other connecting ducts 49 are constantly supplied with fluid from the non-moving axle 38, in which case, during one full rotation of the milling roller 11, all the nozzles 23 have been supplied with fluid but, according to the invention, not simultaneously but rather with offset timing. The relative arrangement of the groove 43 in the axle 38 is again such that only through such connecting ducts 49 is water constantly supplied to those fluid lines 25 which feed the nozzles 23 which are, at that particular time, at the lower reversal point of the milling roller 11 and before it, viewed in the rotational direction 17, that is to say in the working area of the milling cutters 21. Water jets which contribute to preventing the production of dust in the milling area are therefore discharged only from such nozzles 23.

Figure 10:
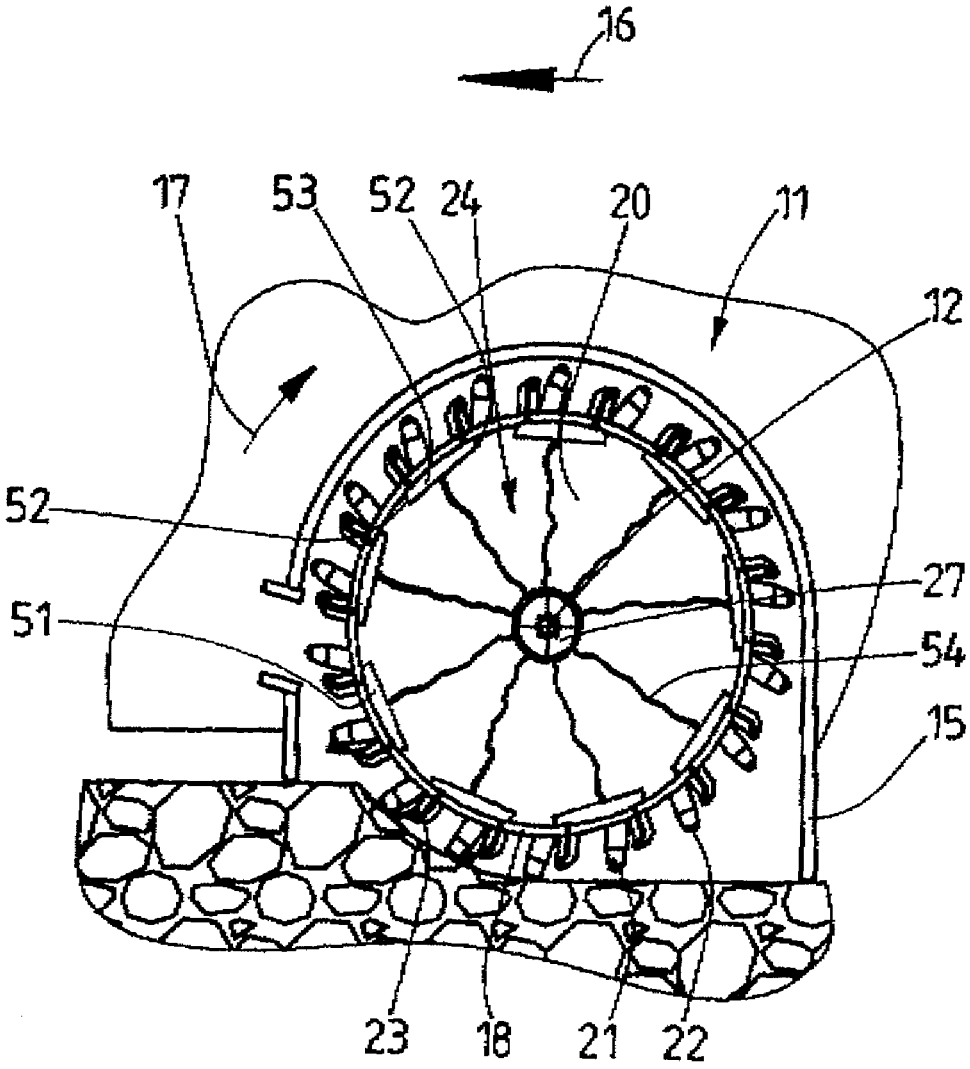
FIG. 10 shows a third exemplary embodiment of the invention in a cross section which is analogous to that in FIG. 6.

The exemplary embodiment in FIG. 10 differs from the previously described exemplary embodiments only in terms of the line system 24. This line system 24 is composed of distributor elements which are embodied as distributor chambers 51, and flexible fluid lines 25. Furthermore, the milling roller 11 of the exemplary embodiment in FIG. 10 is embodied in the same way as the milling rollers 11 in the exemplary embodiments in FIGS. 2 to 9, for which reason identical reference symbols have been used for identical parts in FIG. 10.

Each distributor chamber 51 extends, viewed in the circumferential direction of the milling roller 11, over a plurality of rows of nozzles 23, two successive rows of nozzles 23 in the exemplary embodiment shown. As a result, a plurality of nozzles 23 which are adjacent in the longitudinal and circumferential directions of the milling roller 11 can be supplied with fluid simultaneously by each distributor chamber 51. Because each distributor chamber 51 also simultaneously supplies fluid to nozzles 23 which follow one another in the circumferential direction of the milling roller 11, only nine distributor chambers 51 are provided in the milling roller 11 shown in FIG. 10, said distributor chambers 51 being distributed evenly over the inner circumference of the lateral surface 18 of the milling roller 11, that is to say compared with the previously described exemplary embodiments half the number of distributor pipes 26 are provided.

Each distributor chamber 51 has a U-shaped profile which is flat when viewed in the longitudinal direction of the lateral surface 18 and has comparatively short parallel limbs 52 and an extremely long web 53 which connects the limbs 52. The flat distributor chambers 51 are welded on by the free ends of their limbs 52 to the inner side of the lateral surface 18 of the milling roller 11, and specifically are welded on in a fluid-tight fashion. The length of the distribution chambers 51 is selected such that they extend over at least that area of the width of the milling roller 11 to which milling cutters 21 are assigned. However, it is also conceivable to allow the distributor chambers 51, that is to say the flat U profiles for forming them, to run continuously over the entire width of the lateral surface 18 of the milling roller 11. The free end sides of the U-shaped distributor chambers 51 then end at the drum bottoms 19 of the milling roller 11, to which they are then welded in a fluid-tight fashion.

Each distributor chamber 51 which is embodied in a fluid-tight fashion is fed with fluid, in particular pressurized fluid, by a fluid line 54 which is also preferably flexible in the exemplary embodiment shown. Because in the exemplary embodiment in FIG. 10 the distributor chambers 51 each feed two successive rows of nozzles 23 with pressurized fluid, and accordingly only half the number of distributor chambers 51 compared to the distributor pipes 26 of the two preceding exemplary embodiments are necessary, and also only half the number of fluid lines 54 are necessary, specifically in the exemplary embodiment shown only nine fluid lines 54 are required when there is one fluid line 54 per distributor chamber 51.

In the simplest case water is used as the fluid. The water or the other fluid is preferably provided with an additive which reduces the surface tension of the water. The additive can be, for example, a tenside or the like. The nozzles 23 are also supplied with a pressurized fluid, as a result of which correspondingly highly focused or else diffuse jets of fluid, in particular water jets, are discharged from the nozzles 23.

In a further conceivable exemplary embodiment of the invention (not shown) there is provision for the fluid supply to be provided in particular to the fluid lines of the line system from a rotating drum bottom of the milling roller, for which purpose, instead of the cap 30, a disc or a fixed ring is then assigned at least to that part of the drum bottom 19 in which the fluid lines open in the drum bottom. Here too, individual nozzles or selected groups of nozzles can be successively supplied with fluid during one rotation of the milling roller through corresponding grooves either in the drum bottom or in the disc or the ring, in order to be able to supply the nozzles on a sectoral basis, in particular in the working area of the milling roller.

List of reference numerals

| | |
|---|---|
| 10 | Road miller |
| 11 | Milling roller |
| 12 | Rotational axis |
| 13 | Set of running gear |
| 14 | Running gear frame |
| 15 | Milling roller frame |
| 16 | Milling direction |
| 17 | Rotational direction |
| 18 | Lateral surface |
| 19 | Drum bottom |
| 20 | Interior |
| 21 | Milling cutter |
| 22 | Tip |
| 23 | Nozzle |
| 24 | Line system |
| 25 | Fluid line |
| 26 | Distributor pipe |
| 27 | Shaft |
| 28 | Feed duct |
| 29 | End side |
| 30 | Cap |
| 31 | Bottom wall |
| 32 | Ring wall |
| 33 | Axial seal |
| 34 | Radial seal |
| 35 | Connecting bore |
| 36 | Groove |
| 37 | Seal |
| 38 | Axle |
| 39 | End side |
| 40 | Longitudinal central axis |
| 41 | Feed duct |
| 42 | Connecting duct |
| 43 | Groove |
| 44 | Seal |
| 45 | Distributor bushing |
| 46 | Ring |
| 47 | Bar |
| 48 | Radial seal |
| 49 | Connecting duct |
| 50 | Breakthrough |
| 51 | Distributor chamber |
| 52 | Limb |
| 53 | Web |
| 54 | Fluid line |

What is claimed is:

1. A road miller for removing road coverings, the road miller comprising:

a set of running gear (13) having its own drive;

a milling roller (11) that can be driven in rotation, the milling roller (11) comprising a rotating cylindrical lateral surface (18) having a circumference provided with protruding milling cutters (21) and nozzles (23) for discharging a fluid; and a line system (24) that is fixedly arranged in the interior of the milling roller (11) for supplying the fluid directly to the nozzles (23), wherein the line system (24) rotates in synchronism with the cylindrical lateral surface (18), whereby there is no relative movement between the line system (24) and the milling roller (11).

2. The road miller according to claim 1, wherein individual groups of the nozzles (23) are supplied selectively with the fluid with respect to the circumference of the lateral surface (18) of the milling roller (11), in order to spray a sector on the circumference of the milling roller (11) which stays the same during the rotation of the milling roller (11).

3. The road miller according to claim 1, wherein the milling roller (11) further comprises a central shaft (27) which rotates with the milling roller (11), wherein the line system (24) in the milling roller (11) is supplied with the fluid through the shaft (27).

4. The road miller according to claim 3, further comprising at least one axial feed duct (28) for supplying the fluid to the line system (24), wherein the at least one axial feed duct (28) is arranged in the shaft (27) and is open towards one end (29) of the shaft (27).

5. The road miller according to claim 4, further comprising a non-moving cap (30), wherein the end (29) of the shaft (27) into which the at least one axial feed duct (28) opens is assigned to the non-moving cap (30), which is sealed with respect to the shaft (27) and which has a connection for feeding in the fluid from outside of the milling roller (11).

6. The road miller according to claim 5, wherein a plurality of the axial feed ducts (28) are arranged in the shaft (27), and the non-moving cap (30) is designed to feed in the fluid to just one of the axial feed ducts (28) or to selected ones of the axial feed ducts (28), wherein the axial feed duct (28) or the selected axial feed ducts (28) to which the fluid is fed at a particular time is/are located in a selected area of the circumference of the milling roller (11).

7. The road miller according to claim 1, wherein the milling roller (11) further comprises a central, fixed axle (38) around which the lateral surface (18) and drum bottoms (19) that are assigned to end sides of the lateral surface (18) rotate, wherein the line system (24) of the milling roller (11) is supplied with the fluid through the axle (38).

8. The road miller according to claim 7, wherein at least one feed duct (41) and at least one connecting duct (42) that extends radially outwards from the at least one feed duct (41) are arranged in the axle (38), and in the vicinity of the at least one connecting duct (42) the axle (38) is surrounded in certain areas by at least one rotating distributor bushing (45) that rotates in synchronism with the milling roller (11).

9. The road miller according to claim 8, wherein the distributor bushing (45) has a plurality of connecting ducts (49) distributed on its circumference and in a longitudinal direction to which the line system (24) is connected.

10. The road miller according to claim 8, wherein the at least one connecting duct (42) in the axle (38) and the plurality of connecting ducts (49) in the distributor bushing (45) correspond to one another in such a way that the nozzles (23) are supplied with the fluid only over a specific circumferential sector of the milling roller (11) for a particular time.

11. The road miller according to claim 5, wherein, in the vicinity of the at least one connecting duct (42) the axle (38) is surrounded in certain areas by at least one rotating distributor bushing (45) that rotates in synchronism with the milling roller (11), and wherein the distributor bushing (45) and the non-moving cap (30) are embodied in such a way that the nozzles (23) that are located in the working area of the milling roller (11) are supplied with the fluid only for a particular time.

12. The road miller according to claim 1, wherein the line system (24) has radially directed fluid lines (25) that extend from the center of the milling roller (11).

13. The road miller according to claim 12, wherein the line system (24) has distributor elements in addition to the fluid lines (25).

14. The road miller according to claim 13, wherein each of the distributor elements are supplied with the fluid from at least one of the fluid lines (25).

15. The road miller according to claim 13, wherein a plurality of the nozzles (23) are supplied jointly with the fluid by a respective one of the distributor elements.

16. The road miller according to claim 4, wherein the end (29) of the shaft (27) into which the at least one axial feed duct (28) opens is assigned a non-moving cap (30) that is sealed with respect to the shaft (27) and has a connection for feeding in the fluid from outside of the milling roller (11).

17. The road miller according to claim 16 wherein a plurality of the at least one axial feed ducts (28) is arranged in the shaft (27), and the non-moving cap (30) is designed to feed in the fluid to just one of the at least one axial feed ducts (28) or to selected ones of the at least one axial feed ducts (28), wherein the at least one axial feed duct (28) or the selected ones of the at least one axial feed ducts (28) to which the fluid can be fed at a particular time is/are located in a selected area of the circumference of the milling roller (11).

18. The road miller according to claim 8, wherein the distributor bushing (45) and the non-moving cap (30) are embodied in such a way that the nozzles (23) that are located in the working area of the milling roller (11) are supplied with the fluid only for a particular time.

19. The road miller according to claim 16, wherein the distributor bushing (45) and the non-moving cap (30) are embodied in such a way that the nozzles (23) that are located in the working area of the milling roller (11) are supplied with the fluid only for a particular time.

20. The road miller according to claim 1, wherein the fluid is water.

21. A road miller comprising:

a set of running gear (13) having its own drive;

a milling roller (11) that can be driven in rotation, the milling roller (11) comprising a cylindrical lateral surface (18) having a circumference provided with protruding milling cutters (21) and nozzles (23) for discharging a fluid, and a central shaft (27) which rotates with the milling roller (11);

at least one feed duct (28) arranged in the central shaft (27), wherein the central shaft (27) further comprises an end (29) into which the at least one feed duct (28) opens;

a line system (24) arranged within the milling roller (11) for directly supplying the nozzles (23) with the fluid through the central shaft (27); and a non-moving cap (30) assigned to the end (29) of the central shaft (27) into which the at least one feed duct (28) opens, the non-moving cap (30) being sealed with respect to the central shaft (27) and having a connection for feeding in the fluid from outside of the milling roller (11), and wherein the non-moving cap (30) is designed to feed in the fluid to one of the at least one feed duct (28) or to selected ones of the at least one feed duct (28), wherein the at least one feed duct (28) or the selected ones of the at least one feed duct (28) to which the fluid is fed at a particular time is/are located in a selected area of the circumference of the milling roller (11).

22. The road miller according to claim 21, wherein the fluid is water.

23. A road miller comprising:

a set of running gear (13) having its own drive;

a milling roller (11) that can be driven in rotation, the milling roller (11) comprising a cylindrical lateral surface (18) having end sides and a circumference provided with protruding milling cutters (21) and nozzles (23) for discharging a fluid, and a central, fixed axle (38) around which the lateral surface (18) and drum bottoms (19) that are assigned to the end sides of the lateral surface (18) rotate;

a line system (24) arranged within the milling roller (11) for directly supplying the nozzles (23) with the fluid through the central shaft (27), wherein the line system (24) is supplied with the fluid through the axle (38); and at least one feed duct (41) and at least one connecting duct (42) that extends radially outwards from the at least one feed duct (41) arranged in the axle (38), and in the vicinity of the at least one connecting duct (42) the axle (38) is surrounded in certain areas by at least one rotating distributor bushing (45) that rotates in synchronism with the milling roller (11).

24. The road miller according to claim 23, wherein the fluid is water.

25. A road miller comprising:

a set of running gear (13) having its own drive;

a milling roller (11) that can be driven in rotation, the milling roller (11) comprising a cylindrical lateral surface (18) having a circumference provided with protruding milling cutters (21) and nozzles (23) for discharging a fluid;

a line system (24) arranged within the milling roller (11) for directly supplying the nozzles (23) with the fluid through the central shaft (27), wherein the line system (24) has radially directed fluid lines (25) that extend from the center of the milling roller (11) and distributor elements configured as distributor pipes (26) in addition to the fluid lines (25);

wherein a plurality of the nozzles (23) are supplied jointly with the fluid by respective ones of the distributor elements.

26. The road miller according to claim 25, wherein the fluid is water.

27. A road miller for removing road coverings, the road miller comprising:

a set of running gear (13) having its own drive;

a milling roller (11) that can be driven in rotation, the milling roller (11) comprising (i) a cylindrical lateral surface (18) having a circumference provided with protruding milling cutters (21) and nozzles (23) for discharging a fluid and (ii) a central, fixed axle (38) around which the lateral surface (18) and drum bottoms (19) that are assigned to end sides of the lateral surface (18) rotate; and a line system (24) that is arranged in the interior of the milling roller (11) for supplying the fluid directly to the nozzles (23), wherein the line system (24) is fixedly arranged in the interior of the milling roller 11 so that it rotates in synchronism with the cylindrical lateral surface (18) rotating along with the milling roller (11), whereby there is no relative movement between the line system (24) and the milling roller (11), and wherein the line system (24) is supplied with the fluid through the axle (38).

28. The road miller according to claim 27, wherein the fluid is water.

* * * * *